US012055009B2

(12) United States Patent
Driller et al.

(10) Patent No.: US 12,055,009 B2
(45) Date of Patent: Aug. 6, 2024

(54) DOWNHOLE TOOL WITH DELAY VALVE

(71) Applicant: INNOVEX DOWNHOLE SOLUTIONS, INC., Houston, TX (US)

(72) Inventors: Brent Driller, Houston, TX (US); Nick Tonti, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 214 days.

(21) Appl. No.: 17/713,493

(22) Filed: Apr. 5, 2022

(65) Prior Publication Data

US 2023/0313635 A1 Oct. 5, 2023

(51) Int. Cl.
*E21B 33/12* (2006.01)
*E21B 33/126* (2006.01)
*E21B 33/129* (2006.01)

(52) U.S. Cl.
CPC ..... *E21B 33/1294* (2013.01); *E21B 33/1208* (2013.01); *E21B 33/126* (2013.01)

(58) Field of Classification Search
CPC ..... E21B 33/1294; E21B 34/063; E21B 34/08
See application file for complete search history.

(56) References Cited

U.S. PATENT DOCUMENTS

2010/0051284 A1* 3/2010 Stewart ..... E21B 34/063 251/48
2014/0102709 A1* 4/2014 Arabskyy ..... E21B 43/14 166/308.1
2014/0338923 A1* 11/2014 Fripp ..... E21B 29/02 166/376
2017/0107775 A1* 4/2017 Maenza ..... E21B 23/04
2021/0332667 A1* 10/2021 Dharne ..... E21B 33/1294
2021/0372223 A1* 12/2021 Helms ..... E21B 34/063

* cited by examiner

*Primary Examiner* — David Carroll
(74) *Attorney, Agent, or Firm* — MH2 TECHNOLOGY LAW GROUP, LLP

(57) ABSTRACT

A downhole tool includes a housing defining an axial bore. The downhole tool also includes a piston positioned at least partially within the housing. The piston is configured to actuate from a first piston position into a second piston position at least partially in response to a pressure differential. The downhole tool also includes a locking mechanism positioned at least partially within the housing. The locking mechanism is configured to actuate from a first locking mechanism position into a second locking mechanism position at least partially in response to the pressure differential while the piston is in the second piston position. The downhole tool also includes a disk positioned at least partially within the housing. The disk prevents fluid flow through the axial bore. The disk is configured to break at least partially in response to the pressure differential while the locking mechanism is in the second locking mechanism position.

23 Claims, 9 Drawing Sheets

DOWNHOLE TOOL WITH DELAY VALVE

BACKGROUND

A packer is a downhole tool that can be run into a wellbore. Once in the desired position in the wellbore, the packer may be set or "actuated" to anchor the packer in place and seal a surrounding tubular (e.g., casing, liner, etc.) in the wellbore or the wall of the wellbore. Packers employ flexible, elastomeric elements that can be deformed radially outward to form the seal. Two common types of packers are the production (or test) packer and the inflatable packer. Production packers are generally set by squeezing the elastomeric elements between two plates, forcing the sides to bulge radially outward. Inflatable packers are set by pumping a fluid into a bladder, which again causes the elastomeric element to bulge radially outward. Production or test packers are typically set in cased holes, and inflatable packers may be set in either open or cased holes.

SUMMARY

A downhole tool includes a housing defining an axial bore. The downhole tool also includes a piston positioned at least partially within the housing. The piston is configured to actuate from a first piston position into a second piston position at least partially in response to a pressure differential. The downhole tool also includes a locking mechanism positioned at least partially within the housing. The locking mechanism is configured to actuate from a first locking mechanism position into a second locking mechanism position at least partially in response to the pressure differential while the piston is in the second piston position. The downhole tool also includes a disk positioned at least partially within the housing. The disk prevents fluid flow through the axial bore. The disk is configured to break at least partially in response to the pressure differential while the locking mechanism is in the second locking mechanism position, thereby permitting fluid flow through the axial bore.

In another embodiment, the downhole tool includes a housing. The downhole tool also includes an insert positioned at least partially within the housing. An annulus is defined at least partially between the housing and the insert. The insert defines a radial insert opening. The downhole tool also includes a piston positioned at least partially within the annulus. The piston is configured to actuate in a downhole direction in the annulus from a first piston position into a second piston position at least partially in response to increasing the pressure of the fluid in the axial bore. The piston defines a piston recess in an inner surface thereof. The downhole tool also includes a support ring positioned at least partially within the housing and the insert. The support ring defines a support ring recess in an outer surface thereof. The downhole tool also includes a locking mechanism positioned at least partially in the radial insert opening. The locking mechanism is configured to actuate from the support ring recess into the piston recess at least partially in response to increasing the pressure of the fluid in the axial bore while the piston is in the second piston position. The downhole tool also includes a disk positioned at least partially within the housing. The disk prevents fluid flow through the axial bore. The support ring and the disk are configured to actuate in the downhole direction at least partially in response to increasing the pressure of the fluid in the axial bore while the locking mechanism is positioned in the piston recess. The disk is configured to break at least partially in response to the disk actuating in the downhole direction, thereby permitting fluid flow through the axial bore.

A method for actuating a downhole tool is also disclosed. The method includes running the downhole tool into a wellbore. The method also includes actuating a piston in the downhole tool from a first piston position into a second piston position. The method also includes actuating a locking mechanism in the downhole tool from a first locking mechanism position into a second locking mechanism position while the piston is in the second piston position. The first locking mechanism position is at least partially in a recess in a support ring in the downhole tool. The second locking mechanism position is at least partially in a recess in the piston. The support ring is positioned radially inward from the piston. The method also includes actuating a shear ring in the downhole tool from a first shear ring position into a second shear ring position while the locking mechanism is positioned at least partially in the recess in the piston. The shear ring is positioned at least partially below the support ring. A disk in the downhole tool breaks at least partially in response actuating the shear ring, which permits fluid flow through an axial bore in the downhole tool.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
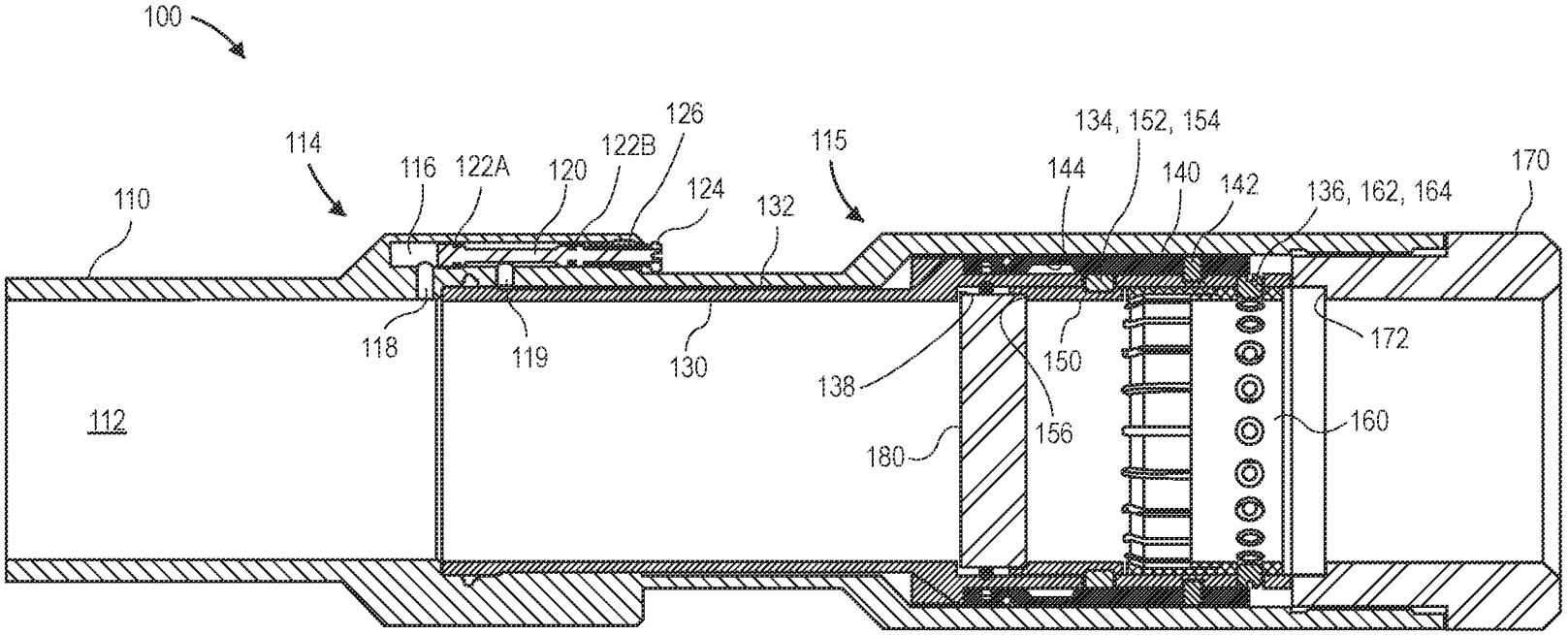
FIG. 1 illustrates a side, cross-sectional view of a downhole tool in a run-in-hole (RIH) state, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, cross-sectional view of a downhole tool 100, according to an embodiment. The downhole tool 100 may provide a temporary barrier for well control and/or a plugging device for a hydraulic set packer. The downhole tool 100 may include a housing 110 that defines an axial bore 112. An outer surface of the housing 110 may include a first (e.g., upper) shoulder 114 and a second (e.g., lower) shoulder 115. The housing 110 may also define an axial port 116 that is substantially parallel to, and radially outward from, the axial bore 112. A first radial port 118 may provide a path of fluid communication between the axial bore 112 and the axial port 116.

The downhole tool 100 may also include a valve (also referred to as a delay valve) 120 that is positioned at least partially within the axial port 116. The valve 120 may include one or more first seals 122A and one or more second seals 122B that are axially offset from one another. The valve 120 may also include a valve cap 124 that may (e.g., initially) be coupled to the housing 110; however, this coupling may be configured to break as described below. The valve 120 may also include a biasing member 126 (e.g., spring) that is configured to exert an axial force on the valve 120 and/or the valve cap 124 in a (e.g., downhole) direction (e.g., to the right in FIG. 1).

The downhole tool 100 may also include an insert 130 that is positioned at least partially within the housing 110. The insert 130 may be generally cylindrical, as shown. The axial bore 112 may extend through the insert 130. An annulus 132 may be defined at least partially (e.g., radially) between the housing 110 and the insert 130. The housing 110 may also define a second radial port 119 that provides a path of fluid communication between the axial port 116 and the annulus 132. The axial port 116, the first radial port 118, the second radial port 119, the valve 120, or a combination thereof may be defined and/or positioned at least partially within the first shoulder 114 and/or above the second shoulder 115.

The downhole tool 100 may also include a piston 140 that is positioned at least partially within the annulus 132. The insert 130 may (e.g., initially) be coupled to the piston 140 via one or more first pins (e.g., shear pins) 142 that is/are designed to break in response to a predetermined pressure/force. An inner surface of the piston 140 may define a recess 144 that has tapered sides. The tapered sides may be oriented at an acute angle (i.e., not perpendicular) to axis through the downhole tool 100.

The downhole tool 100 may also include a support ring 150 that is positioned at least partially within the housing 110. The support ring 150 may be positioned radially inward from the housing 110, the insert 130, the piston 140, or a combination thereof. The support ring 150 may (e.g., initially) be coupled to the insert 130. More particularly, the support ring 150 may define one or more recesses 152 formed in an outer surface thereof. The recess(es) 152 may have tapered sides. The insert 130 may define one or more first (e.g., upper) openings 134 formed radially therethrough.

One or more locking mechanisms 154 may be positioned within the housing 110. The locking mechanism(s) 154 may be configured to actuate from a first locking mechanism position into a second locking mechanism position at least partially in response to a pressure differential while the piston 130 is in the second piston position. For example, the locking mechanism(s) 154 may be or include one or more lugs that is/are (e.g., initially) positioned at least partially within the opening(s) 134 and/or the recess(es) 152 to prevent axial movement between the insert 130 and the support ring 150.

The downhole tool 100 may also include a shear ring 160 that is positioned at least partially within the housing 110. The shear ring 160 may be positioned radially inward from the housing 110, the insert 130, the piston 140, the support ring 150, or a combination thereof. The shear ring 160 may also be positioned below (e.g., to the right in FIG. 1) the support ring 150. The shear ring 160 may (e.g., initially) be coupled to the insert 130. More particularly, the shear ring 160 may define one or more openings or recesses 162 formed in an outer surface thereof, and the insert 130 may define one or more second (e.g., lower) openings or recesses 136 formed in an inner surface thereof. One or more second pins (e.g., shear pins) 164 may (e.g., initially) be positioned at least partially within the openings/recesses 136 and the openings/recesses 162 to prevent axial movement between the insert 130 and the shear ring 160. As shown, a plurality of second pins 164 may be used that are circumferentially offset from one another.

The downhole tool 100 may also include a retainer ring 170 that is coupled to the housing 110. The retainer ring 170 may be positioned below (e.g., to the right in FIG. 1) the housing 110, the insert 130, the piston 140, the support ring 150, the shear ring 160, or a combination thereof. The lower end of the insert 130 may be in contact with the upper end of the retainer ring 170. The lower end of the piston 140 may initially be spaced apart from (e.g., above) the retainer ring 170 but the lower end of the piston 140 may be configured to slide downward and contact the upper end of the retainer ring 170 as described below. The retainer ring 170 may define a shoulder 172 in the inner surface thereof. The shear ring 160 may initially be spaced apart from (e.g., above) the retainer ring 170, but the shear ring 160 may be configured to slide downward and contact the shoulder 172 as described below.

The downhole tool 100 may also include a disk 180 that is positioned at least partially within the housing 110. The disk 180 may be positioned radially inward from the housing 110, the insert 130, the piston 140, the support ring 150, or a combination thereof. The disk 180 may be positioned above the shear ring 160 and the retainer ring 170. The disk 180 may be secured axially between a shoulder 138 in the insert 130 and/or a shoulder 156 in the support ring 150. The disk 180 may be configured to prevent fluid in the axial bore 112 from flowing axially therepast/therethrough. The disk 180 may be made of a material (e.g., glass) that is configured to break in response to a predetermined pressure and/or a contact force as described below.

Although not shown, a packer (e.g., a hydraulic packer) may be positioned above the downhole tool 100 and/or coupled to the housing 110. The packer may also or instead be positioned below the downhole tool 100 and/or coupled to the retainer ring 170.

Figure 2:
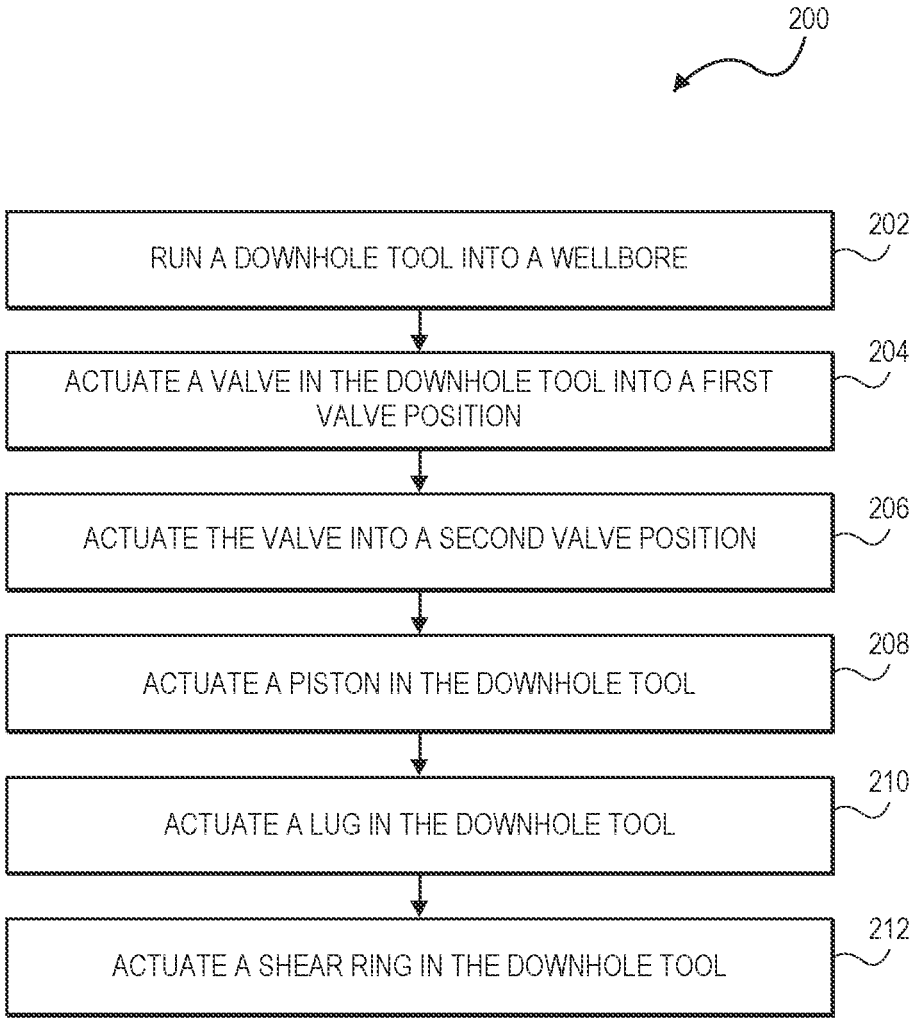
FIG. 2 illustrates a flowchart of a method for actuating the downhole tool, according to an embodiment.

FIG. 2 illustrates a flowchart of a method 200 for actuating the downhole tool 100, according to an embodiment. An illustrative order of the method 200 is provided below; however, one or more steps of the method 200 may be performed in a different order, combined, split, repeated, or omitted.

The method 200 may include running the downhole tool 100 into a wellbore, as at 202. The downhole tool 100 may be run into the wellbore in a run-in-hole (RIH) state, which is shown in FIG. 1. In the RIH state, the valve 120 may be positioned such that the first seal(s) 122A is/are positioned between the first and second radial ports 118, 119, thereby preventing fluid flow between the axial bore 112 and the annulus 132 via the axial port 116. The annulus 132 may be at atmospheric pressure or any other starting, e.g., relatively low pressure.

Figure 3:
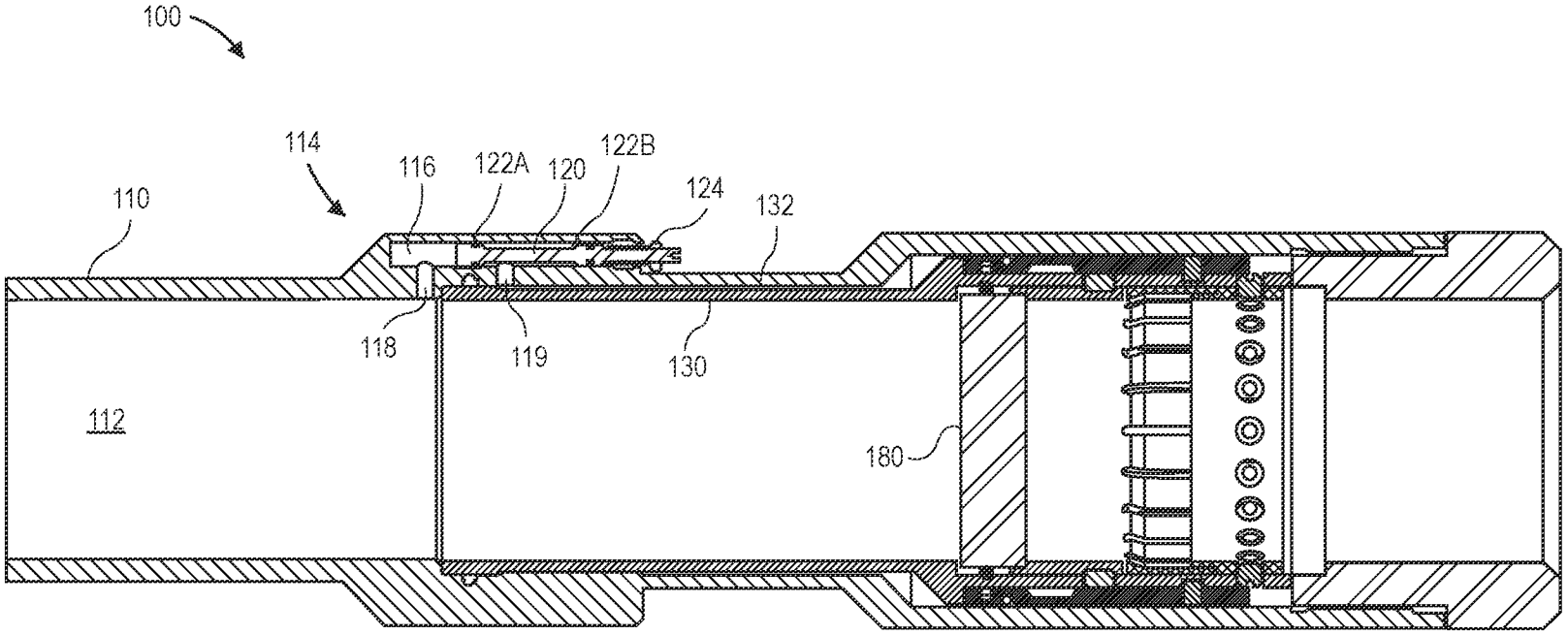
FIG. 3 illustrates a side, cross-sectional view of the downhole tool showing a delay valve actuated into a first position, according to an embodiment.

Once in the desired location in the wellbore, the method 200 may also include actuating the valve 120 into a first valve position, as at 204. This may be part of a packer setting sequence. Actuating the valve 120 into the first valve position may include increasing a pressure of the fluid in the axial bore 112 above the disk 180 (e.g., using a pump at the surface). This may cause the pressure inside the axial bore 112 above the disk 180 to become greater than the pressure of the fluid outside of the downhole tool 100 (e.g., in the annulus between the downhole tool 100 and the casing or wellbore wall). In response to the pressure differential reaching or exceeding a first predetermined threshold, the connection between the housing 110 and the valve 120 or the valve cap 124 may break, allowing the valve 120 to move within the axial port 116 in a first (e.g., downhole) direction into the first valve position. This is shown in FIG. 3, as the valve 120 is shifted to the right, and extends out of the axial port 116. The valve 120 may be prevented from completely exiting the axial port 116. During and/or after the movement, the valve 120 may be positioned such that the first seal(s) 122A is/are positioned between the first and second radial ports 118, 119, thereby preventing fluid flow between the axial bore 112 and the annulus 132.

Figure 4:
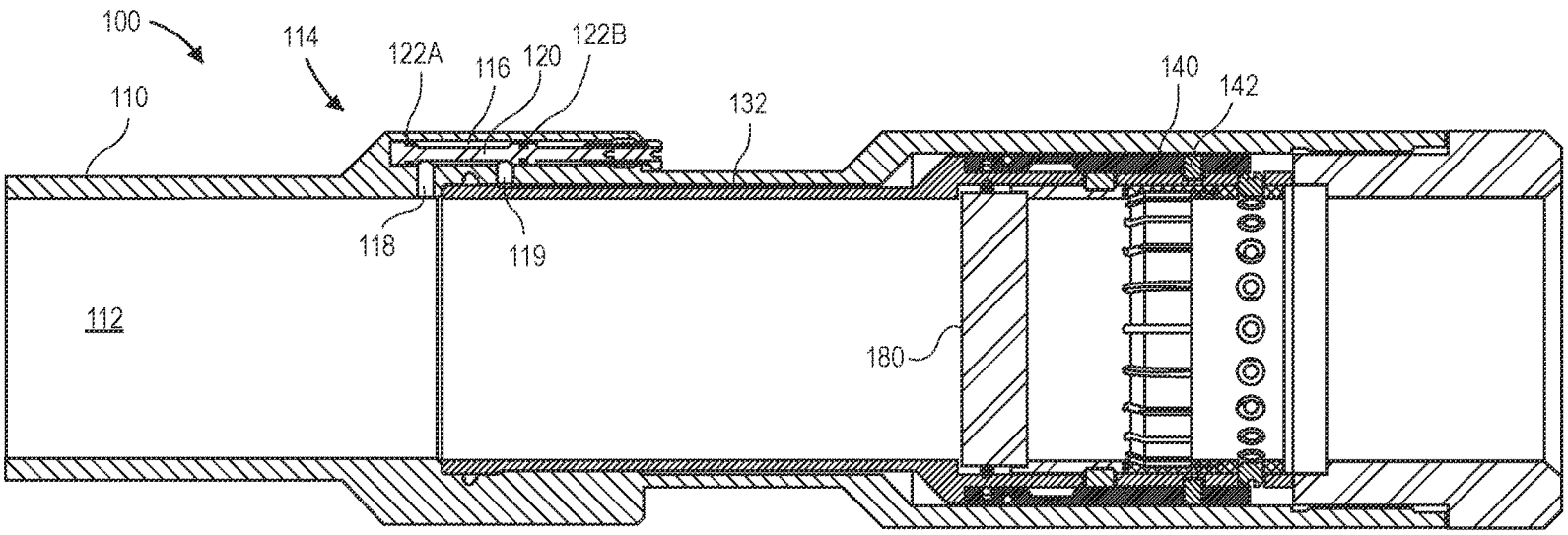
FIG. 4 illustrates a side, cross-sectional view of the downhole tool showing the delay valve actuated into a second position, according to an embodiment.

The method 200 may also include actuating the valve 120 into a second valve position, as at 206. This may occur before, during, or after the packer setting sequence. Actuating the valve 120 into the second valve position may include decreasing (e.g., bleeding off) the pressure of the fluid in the axial bore 112 above the disk 180, which may cause the pressure inside the axial bore 112 to become less than the pressure of the fluid outside of the downhole tool 100. In response to the pressure differential reaching or falling below a second predetermined threshold, the valve 120 may move within the axial port 116 in the second (e.g., uphole) direction into the second valve position (also referred to as an open position). This is shown in FIG. 4. When the valve 120 is in the second valve position, neither the first seal(s) 122A nor the second seal(s) 122B are positioned between the first and second radial ports 118, 119, allowing fluid communication between the axial bore 112 and the annulus 132 via the axial port 116. The valve 120 may prevent fluid outside of the downhole tool 100 from entering the axial bore 112 and/or the annulus 132. The seals 122A, 122B may serve to maintain the position of the valve 120 and permit fluid flow between the bore 112 and the annulus 132, even if the pressure outside of the downhole tool 100 varies (e.g., increases).

Figure 5:
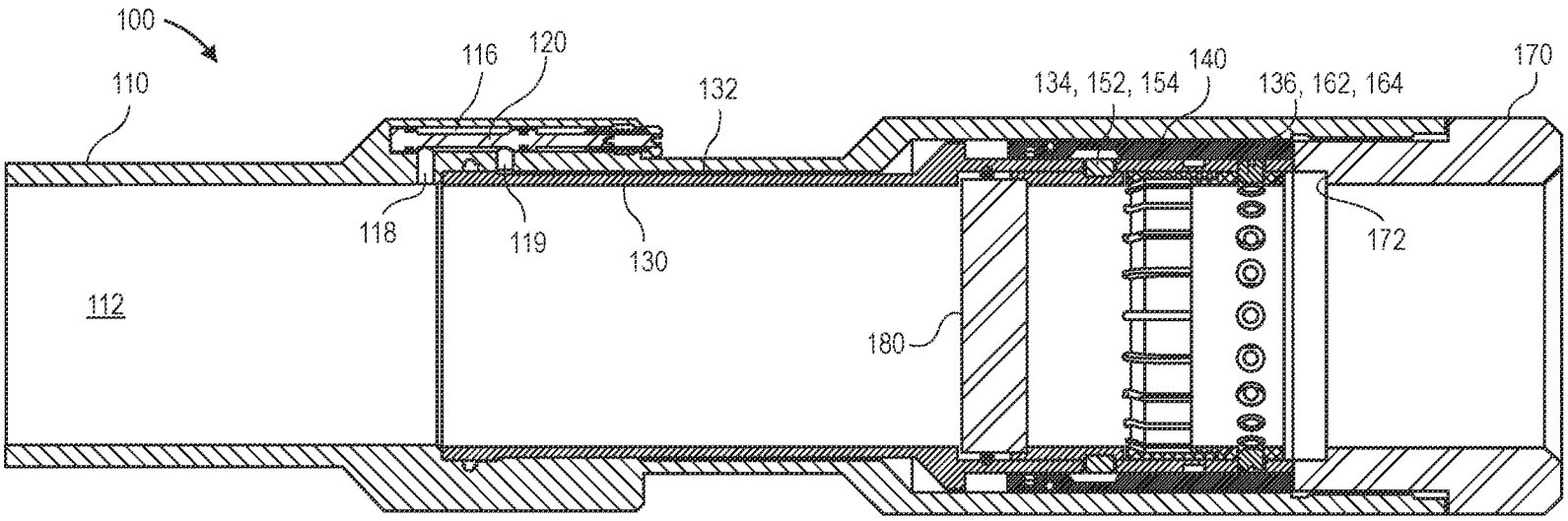
FIG. 5 illustrates a side, cross-sectional view of the downhole tool showing a piston actuated from a first position into a second position, according to an embodiment.

The method 200 may also include actuating the piston 140, as at 208. Actuating the piston 140 may include (again) increasing the pressure of the fluid in the axial bore 112 above the disk 180 (e.g., using the pump at the surface). With the valve 120 now in the second valve position, the fluid (e.g., pressure) may flow from the axial bore 112, through the ports 116, 118, 119, and into the annulus 132, where the fluid (e.g., pressure) may exert an axial force on the piston 140 in the downhole direction. In response to the pressure reaching or exceeding a third predetermined threshold, the first pin(s) 142 (see FIG. 4) may break, allowing the piston 140 to move in the downhole direction and into contact with the retainer ring 170. This is shown in FIG. 5. In other words, the piston 140 moves from a first piston position (FIG. 4) into a second piston position (FIG. 5).

Figure 6:
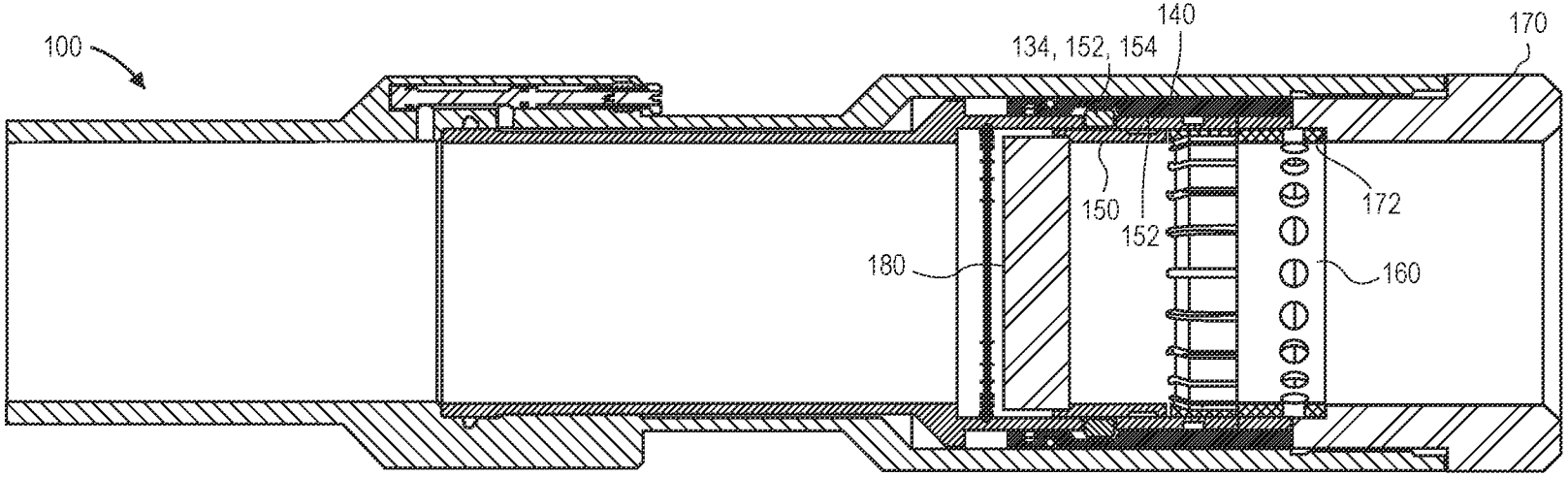
FIG. 6 illustrates a side, cross-sectional view of the downhole tool showing a locking mechanism actuated from a first position into a second position, according to an embodiment.

Once the piston 140 contacts the retainer ring 170, the locking mechanism(s) 154 may now be unlocked. More particularly, the locking mechanism(s) 154 may be aligned with the recess(es) 144 in the inner surface of the piston 140. The method 200 may also include actuating the locking mechanism(s) 154, as at 210. The pressure at step 208 (or an even greater pressure) may exert a downward force on the disk 180 and the support ring 150. This force, combined with the tapered sides of the recess(es) 152 in the support ring 150, may cause the locking mechanism(s) 154 to move radially outward from the recess(es) 152 in the support ring 150 into the recess(es) 144 in the piston 140. This is shown in FIG. 6. In other words, the locking mechanism(s) 154 move from a first locking mechanism position (FIG. 5) into a second locking mechanism position (FIG. 6).

Figure 7:
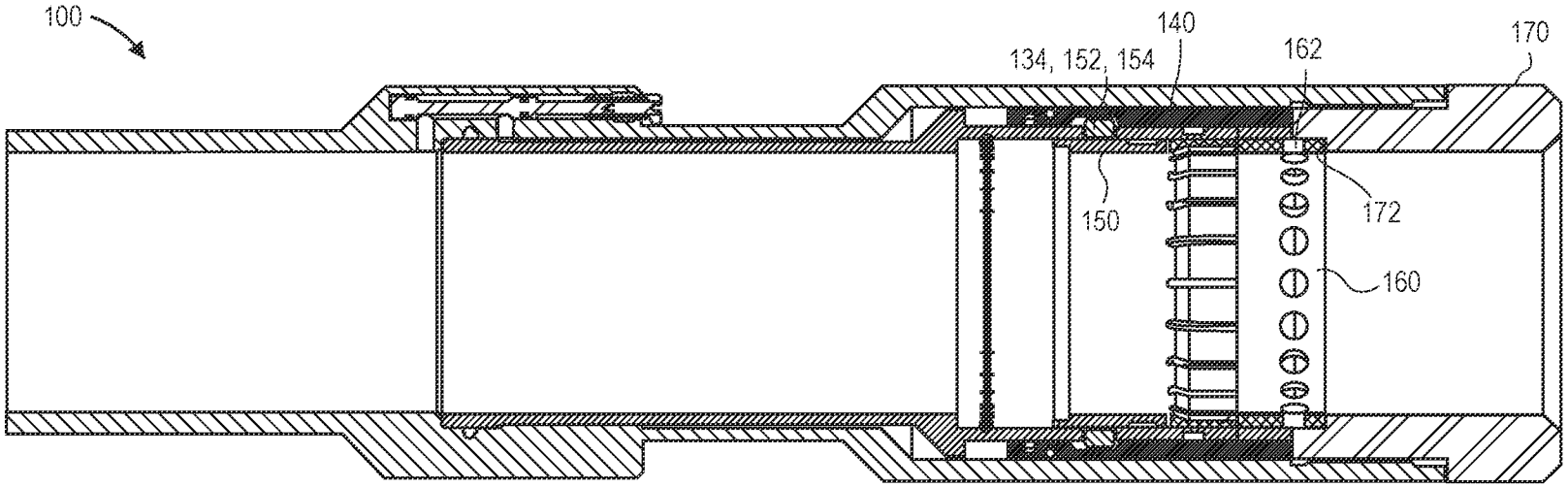
FIG. 7 illustrates a side, cross-sectional view of the downhole tool showing a disk having shattered (e.g., the disk is no longer visible in FIG. 7) in response to a support ring, a shear ring, and the disk actuating from a first position into a second position, according to an embodiment.

Once the locking mechanism(s) 154 move into the second locking mechanism position, the downward force may be exerted on the disk 180, the support ring 150, and now the shear ring 160. Thus, the method 200 may also include actuating the shear ring 160, as at 212. The shear ring 160 may be actuated in response to the same pressure used at step 208, or the pressure may be increased (e.g., using the pump at the surface). In response to the downhole force exerted on the disk 180, the support ring 150, and the shear ring 160 by the (e.g., increased) pressure, the second pins 164 (see FIG. 5) may break. The disk 180, the support ring 150, and the shear ring 160 may then move in the downhole direction until the shear ring 160 contacts the inner shoulder 172 on the retainer ring 170. In other words, the disk 180, the support ring 150, and the shear ring 160 may move from a first position (FIG. 5) to a second position (FIGS. 6 and 7). The sudden stop once the inner shoulder 172 is contacted may exert a contact force on the disk 180. The contact force (e.g., in the uphole direction), the force exerted by the fluid pressure (e.g., in the downhole direction), or both may cause the disk 180 to break, which may permit fluid flow through the axial bore 112. This is shown in FIG. 7.

In one embodiment, the second pins 164 may be configured to break at different times to cause a first circumferential portion of the shear ring 160 (and the support ring 150 and the disk 180) to move in the downhole direction before or after a second circumferential portion of the shear ring 160. The second pins 164 may be configured to break at different times by creating uneven circumferential spacing between the second pins 164, using second pins 164 of different materials, using second pins 164 of different thicknesses, or the like. As a result, the contact force may be concentrated at a corresponding first circumferential portion of the disk 180 to help ensure that the disk 180 breaks.

Figure 8:
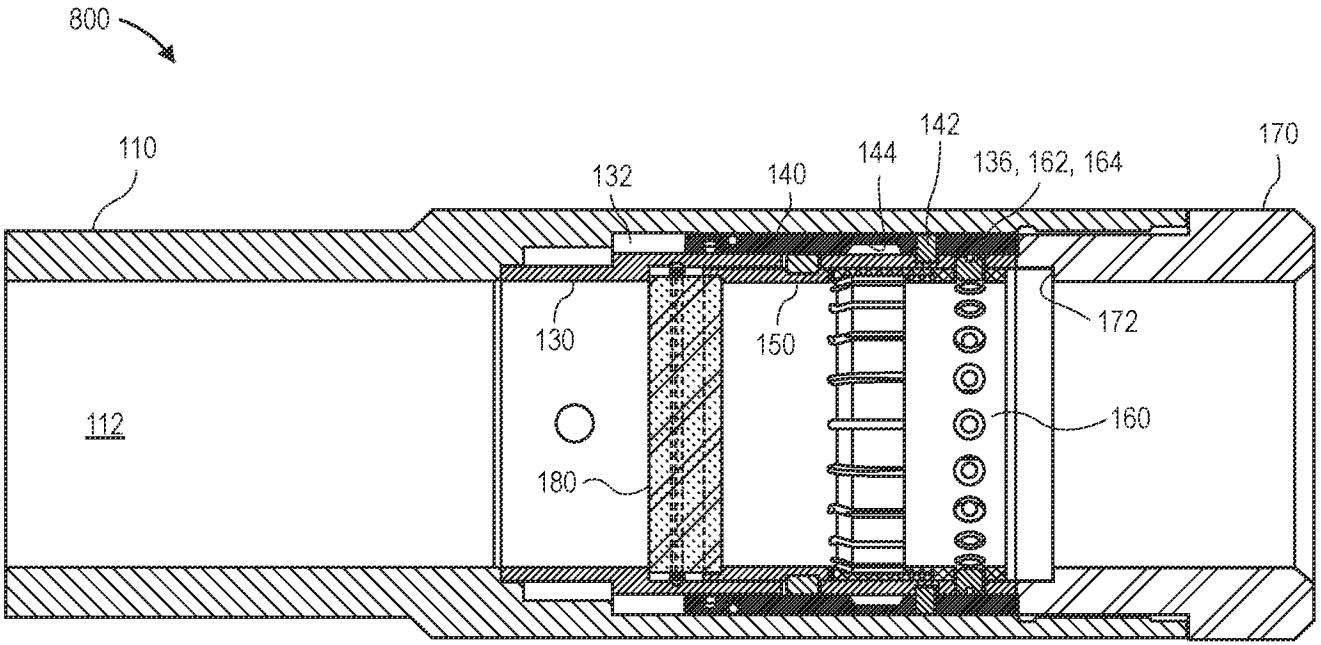
FIG. 8 illustrates a side, cross-sectional view of another downhole tool, according to an embodiment.

FIG. 8 illustrates a side, cross-sectional view of another downhole tool 800, according to an embodiment. The downhole tool 800 may be similar to the downhole tool 100. For example, the downhole tool 800 may also include the housing 110, the insert 130, the piston 140, the support ring 150, the shear ring 160, the retainer ring 170, the disk 180, or a combination thereof. However, the downhole tool 800 may not include ports 116, 118, 119 and/or the valve 120.

Figure 9:
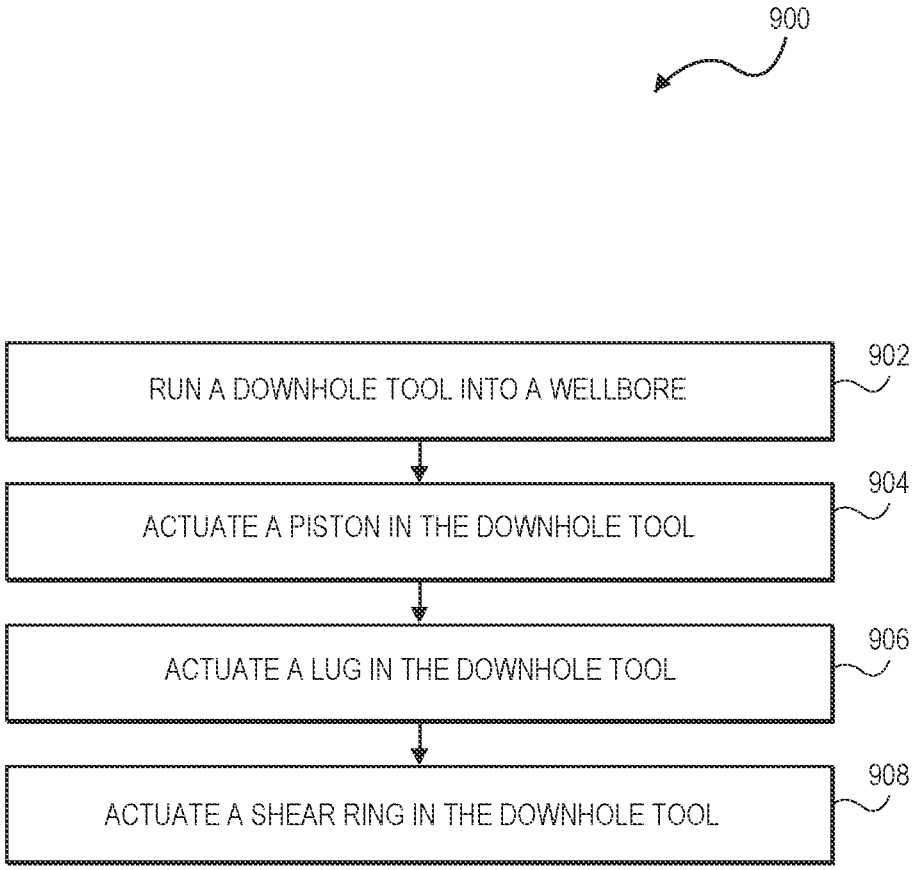
FIG. 9 flowchart of a method for actuating the downhole tool shown in FIG. 8, according to an embodiment.

FIG. 9 flowchart of a method 900 for actuating the downhole tool 800, according to an embodiment. An illustrative order of the method 900 is provided below; however, one or more steps of the method 900 may be performed in a different order, combined, split, repeated, or omitted.

The method 900 may include running the downhole tool 800 into a wellbore, as at 902. The downhole tool 800 may be run into the wellbore in a RIH state, which is shown in FIG. 8. This may be part of the packer setting sequence.

Figure 10:
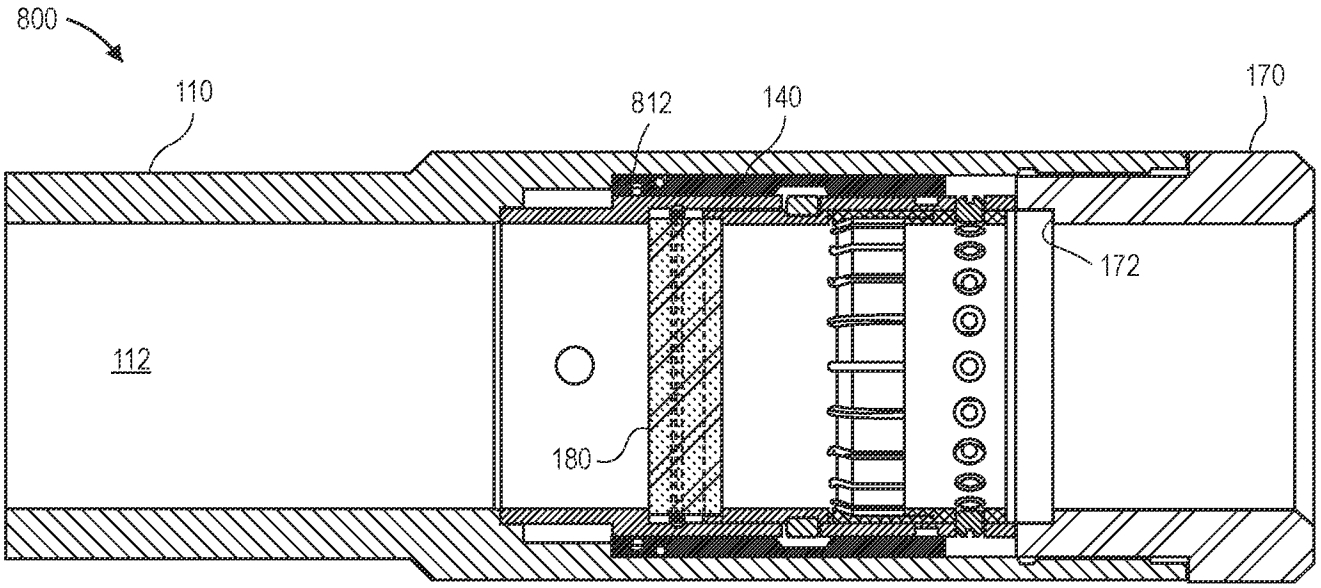
FIG. 10 illustrates a side, cross-sectional view of the downhole tool showing the piston actuated from a first position into a second position, according to an embodiment.

The method 900 may also include actuating the piston 140, as at 904. Actuating the piston 140 may include causing the pressure in the axial bore 112 below the piston 140 and/or disk 180 to become greater than the pressure in the axial bore 112 above the piston 140 and/or disk 180. In other words, the wellbore may become underbalanced. This may be accomplished by increasing the pressure in the annulus outside of the downhole tool 800 (e.g., using the pump at the surface). In response to the pressure differential, the first pin(s) 142 may break, allowing the piston 140 to move in the uphole direction and into contact with a first inner shoulder in 812 the housing 110. In other words, the piston 140 may move from a first piston position (FIG. 8) into a second piston position (FIG. 10).

Figure 11:
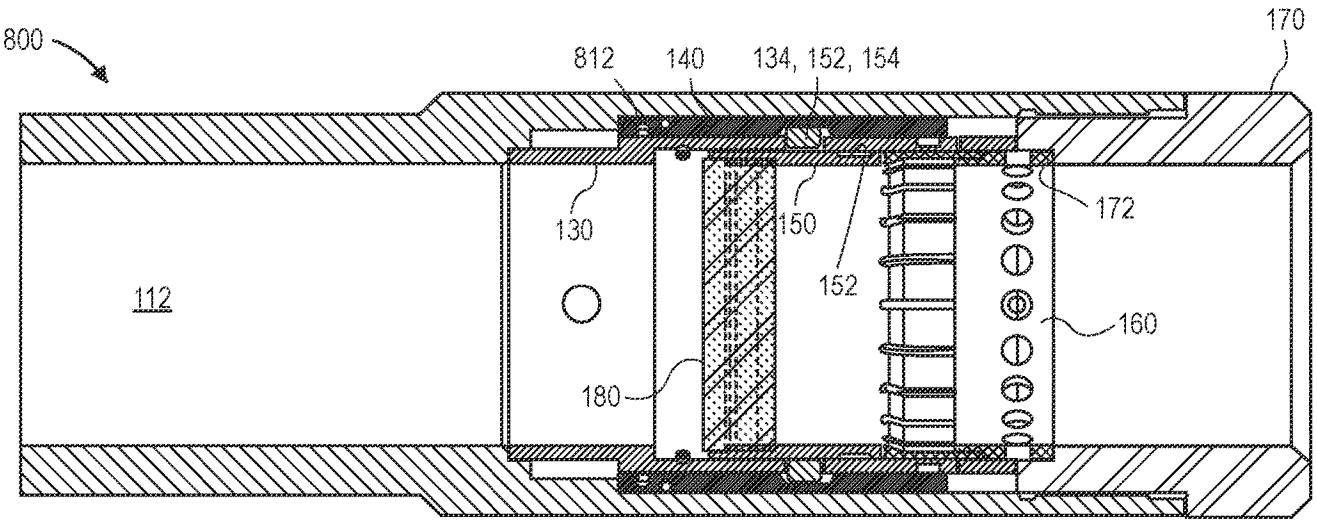
FIG. 11 illustrates a side, cross-sectional view of the downhole tool showing the locking mechanism actuated from a first position into a second position, according to an embodiment.

Once the piston 140 contacts the first inner shoulder in 812 in the housing 110, the locking mechanism(s) 154 may now be aligned with the recess(es) 144 in the inner surface of the piston 140. The method 900 may also include actuating the locking mechanism(s) 154, as at 906. The locking mechanism(s) 154 may be actuated in response to increasing the pressure in the axial bore 112 above the disk 180 (e.g., using the pump at the surface) so that the wellbore is no longer underbalanced. This pressure may exert a force on the disk 180, the support ring 150, and the shear ring 160 in the downhole direction. This force, combined with the tapered sides of the recess(es) 152 in the support ring 150, may cause the locking mechanism(s) 154 to move radially outward from the recess(es) 152 in the support ring 150 into the recess(es) 144 in the piston 140. This is shown in FIG. 11. In other words, the locking mechanism(s) 154 may move from the first locking mechanism position (FIG. 10) into the second locking mechanism position (FIG. 11).

Figure 12:
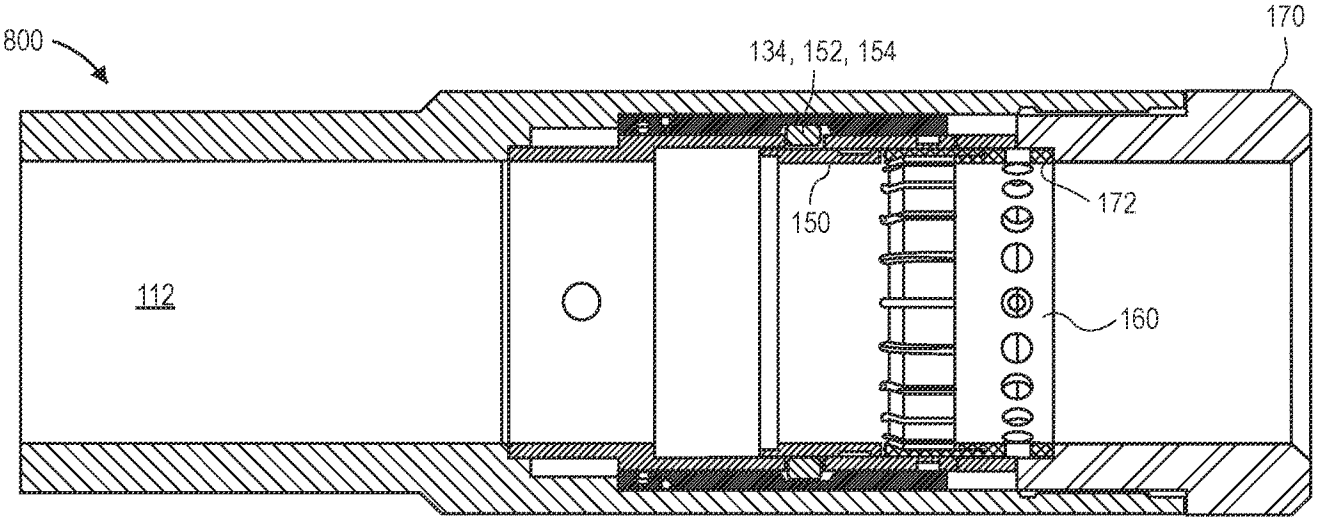
FIG. 12 illustrates a side, cross-sectional view of the downhole tool showing the disk having shattered (e.g., the disk is no longer visible in FIG. 12) in response to the support ring, the shear ring, and the disk actuating from a first position into a second position, according to an embodiment.

Once the locking mechanism(s) 154 move radially outward into the second locking mechanism position, the method 900 may include actuating the shear ring 160, as at 908. More particularly, in response to the pressure exerted at 906 (or an increased pressure), the downward force may be exerted on the disk 180, the support ring 150, and now the shear ring 160. This may cause the second pins 164 to break. The disk 180, the support ring 150, and the shear ring 160 may then move in the downhole direction until the shear ring 160 contacts the inner shoulder 172 on the retainer ring 170. This is shown in FIGS. 11 and 12. The sudden stop once the inner shoulder 172 is contacted may exert a contact force on the disk 180. The contact force (e.g., in the uphole direction), the force exerted by the fluid pressure (e.g., in the downhole direction), or both may cause the disk 180 to break, which may permit fluid flow through the axial bore 112.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a housing defining:

an axial bore; and an axial port that is substantially parallel to the axial bore and radially outward from the axial bore;

a valve positioned at least partially within the axial port, wherein the valve is configured to be exposed to a fluid in a wellbore annulus;

a piston positioned at least partially within the housing, wherein the piston is configured to actuate from a first piston position into a second piston position at least partially in response to a pressure differential;

a locking mechanism positioned at least partially within the housing, wherein the locking mechanism is configured to actuate from a first locking mechanism position into a second locking mechanism position at least partially in response to the pressure differential while the piston is in the second piston position; and a disk positioned at least partially within the housing, wherein the disk prevents fluid flow through the axial bore, wherein the disk is configured to break at least partially in response to the pressure differential while the locking mechanism is in the second locking mechanism position, thereby permitting fluid flow through the axial bore.

2. The downhole tool of claim 1, wherein the housing also defines:

a first radial port that provides a path of fluid communication between the axial bore and the axial port; and a second radial port that is axially offset from the first radial port, wherein the second radial port provides a path of fluid communication between the axial port and an annulus in the housing.

3. The downhole tool of claim 2, wherein the valve is configured to actuate into a first valve position that prevents fluid flow between the first and second radial ports in response to increasing a pressure of a fluid in the axial bore, and wherein the valve is configured to actuate into a second valve position that permits the fluid flow between the first and second radial ports in response to decreasing the pressure of the fluid in the axial bore.

4. The downhole tool of claim 2, wherein the valve is between the first and second radial ports.

5. The downhole tool of claim 2, wherein the piston is below the first and second radial ports.

6. The downhole tool of claim 2, wherein the second radial port is unplugged when the downhole tool is in a wellbore.

7. The downhole tool of claim 1, wherein the piston is configured to actuate in a downhole direction from the first piston position to the second piston position.

8. A downhole tool, comprising:

a housing defining an axial bore;

a piston positioned at least partially within the housing, wherein the piston is configured to actuate from a first piston position into a second piston position at least partially in response to a pressure differential;

a locking mechanism positioned at least partially within the housing, wherein the locking mechanism is configured to actuate from a first locking mechanism position into a second locking mechanism position at least partially in response to the pressure differential while the piston is in the second piston position; and a disk positioned at least partially within the housing, wherein the disk prevents fluid flow through the axial bore, wherein the disk is configured to break at least partially in response to the pressure differential while the locking mechanism is in the second locking mechanism position, thereby permitting fluid flow through the axial bore.

9. A downhole tool, comprising:

a housing defining an axial bore;

a piston positioned at least partially within the housing, wherein the piston is configured to actuate from a first piston position into a second piston position at least partially in response to a pressure differential;

a locking mechanism positioned at least partially within the housing, wherein the locking mechanism is configured to actuate from a first locking mechanism position into a second locking mechanism position at least partially in response to the pressure differential while the piston is in the second piston position;

a disk positioned at least partially within the housing, wherein the disk prevents fluid flow through the axial bore, wherein the disk is configured to break at least partially in response to the pressure differential while the locking mechanism is in the second locking mechanism position, thereby permitting fluid flow through the axial bore; and an insert positioned at least partially within the housing, wherein an annulus is defined at least partially between the housing and the insert, wherein the piston is positioned at least partially within the annulus, and wherein the locking mechanism comprises a lug that is positioned at least partially within a radial insert opening in the insert.

10. The downhole tool of claim 9, wherein the lug is configured to actuate from a recess in a support ring into a recess in the piston at least partially in response to the pressure differential while the piston is in the second piston position.

11. The downhole tool of claim 10, further comprising a shear ring positioned at least partially within the housing and below the support ring, wherein the support ring, the disk, and the shear ring are configured to move in a downhole direction at least partially in response to the pressure differential while the lug is positioned in the recess in the piston.

12. The downhole tool of claim 11, further comprising a retainer ring positioned at least partially within the housing and below the piston and the shear ring, wherein the shear ring contacts the retainer ring while moving in the downhole direction, and wherein the disk breaks at least partially in response to the shear ring contacting the retainer ring.

13. The downhole tool of claim 11, wherein a first circumferential portion of the disk is configured to actuate in the downhole direction prior to a second circumferential portion of the disk.

14. A downhole tool, comprising:

a housing;

an insert positioned at least partially within the housing, wherein an annulus is defined at least partially between the housing and the insert, and wherein the insert defines a radial insert opening;

a piston positioned at least partially within the annulus, wherein the piston is configured to actuate in an axial direction in the annulus from a first piston position into a second piston position at least partially in response to changing the pressure of the fluid in the axial bore, and wherein the piston defines a piston recess in an inner surface thereof;

a support ring positioned at least partially within the housing and the insert, wherein the support ring defines a support ring recess in an outer surface thereof;

a locking mechanism positioned at least partially in the radial insert opening, wherein the locking mechanism is configured to actuate from the support ring recess into the piston recess at least partially in response to increasing the pressure of the fluid in the axial bore while the piston is in the second piston position; and a disk positioned at least partially within the housing, wherein the disk prevents fluid flow through the axial bore, wherein the support ring and the disk are configured to actuate in the downhole direction at least partially in response to increasing the pressure of the fluid in the axial bore while the locking mechanism is positioned in the piston recess, and wherein the disk is configured to break at least partially in response to the disk actuating in the downhole direction, thereby permitting fluid flow through the axial bore.

15. The downhole tool of claim 14, wherein the housing defines:

an axial bore;

an axial port that is substantially parallel to the axial bore and radially outward from the axial bore;

a first radial port that provides a path of fluid communication between the axial bore and the axial port; and a second radial port that is axially offset from the first radial port, wherein the second radial port provides a path of fluid communication between the axial port and the annulus.

16. The downhole tool of claim 15, further comprising a valve positioned at least partially within the axial port, wherein the valve is configured to actuate into a first valve position that prevents fluid flow between the first and second radial ports in response to increasing a pressure of a fluid in the axial bore, and wherein the valve is configured to actuate into a second valve position that permits the fluid flow between the first and second radial ports in response to decreasing the pressure of the fluid in the axial bore.

17. The downhole tool of claim 14, further comprising a shear ring positioned at least partially within the housing and below the support ring and the disk, wherein the shear ring is configured to actuate in the downhole direction together with the support ring and the disk.

18. The downhole tool of claim 17, further comprising a retainer ring positioned at least partially within the housing and below the piston and the shear ring, wherein the retainer ring defines a shoulder on an inner surface thereof, and wherein the disk is configured to break at least partially in response to the shear ring contacting the shoulder.

19. A method for actuating a downhole tool, the method comprising:

running the downhole tool into a wellbore;

actuating a piston in the downhole tool from a first piston position into a second piston position;

actuating a locking mechanism in the downhole tool from a first locking mechanism position into a second locking mechanism position while the piston is in the second piston position, wherein the first locking mechanism position is at least partially in a recess in a support ring in the downhole tool, wherein the second locking mechanism position is at least partially in a recess in the piston, and wherein the support ring is positioned radially inward from the piston; and actuating a shear ring in the downhole tool from a first shear ring position into a second shear ring position while the locking mechanism is positioned at least partially in the recess in the piston, wherein the shear ring is positioned at least partially below the support ring, and wherein a disk in the downhole tool breaks at least partially in response actuating the shear ring, which permits fluid flow through an axial bore in the downhole tool.

20. The method of claim 19, further comprising:

actuating a valve in the downhole tool into a first valve position; and actuating the valve in the downhole tool into a second valve position after the first valve position, wherein the piston is actuated while the valve is in the second valve position.

21. The method of claim 19, further comprising causing the wellbore to become underbalanced, which actuates the piston actuates in an uphole direction from the first piston position to the second piston position.

22. The method of claim 19, wherein actuating the shear ring causes the support ring, the shear ring, and the disk to move in a downhole direction until the shear ring contacts a shoulder, and wherein the disk breaks at least partially in response to the shear ring contacting the shoulder.

23. The method of claim 22, wherein a first circumferential portion of the disk is configured to actuate in the downhole direction prior to a second circumferential portion of the disk.

* * * * *